US006801105B2

(12) United States Patent
Karhu

(10) Patent No.: US 6,801,105 B2
(45) Date of Patent: Oct. 5, 2004

(54) RESONATOR OF RADIO-FREQUENCY FILTER

(75) Inventor: Kimmo Karhu, Oulu (FI)

(73) Assignee: Remec Oy, Oulu (FI)

( * ) Notice: Subject to any disclaimer, the term of this patent is extended or adjusted under 35 U.S.C. 154(b) by 0 days.

(21) Appl. No.: 10/404,929

(22) Filed: Apr. 1, 2003

(65) Prior Publication Data

US 2003/0193378 A1 Oct. 16, 2003

(30) Foreign Application Priority Data

Apr. 11, 2002 (FI) ..... 20020697

(51) Int. Cl.[7] ..... H01P 7/10
(52) U.S. Cl. ..... 333/202; 333/219
(58) Field of Search ..... 333/202, 219, 333/219.1, 222, 224, 227, 230, 231, 232

(56) References Cited

U.S. PATENT DOCUMENTS 5,659,275 A * 8/1997 Kurisu et al. ..... 333/219.1
6,437,655 B1 * 8/2002 Andoh et al. ..... 333/17.1

FOREIGN PATENT DOCUMENTS

| | | |
|---|---|---|
| EP | 1006603 | 6/2000 |
| FI | 94191 | 4/1995 |
| JP | 01220501 | 9/1989 |
| JP | 07106803 | 4/1995 |
| JP | 10173414 | 6/1998 |

OTHER PUBLICATIONS

Patent Abstract of Japan of JP 01220501 dated Sep. 1989.
Patent Abstract of Japan of JP 07106803 dated Apr. 21, 1995.
Patent Abstract of Japan of JP 10173414 dated Jun. 26, 1998.

* cited by examiner

*Primary Examiner*—Linh M. Nguyen
(74) *Attorney, Agent, or Firm*—Ladas & Parry

(57) ABSTRACT

The invention relates to a dielectric double-mode resonator of a radio-frequency filter that comprises a block structure comprising at least two resonator structures having at least one resonance mode each. In addition, said block structure comprises a cavity wall that limits a cavity at least partly inside the block structure, the cavity affecting the resonance modes of the at least two resonator structures. The block structure comprises a first block and a second block set against each other and each comprising at least part of the at least two resonator structures and at least part of the cavity wall limiting the cavity.

20 Claims, 11 Drawing Sheets

RESONATOR OF RADIO-FREQUENCY FILTER

FIELD

Figure 1:
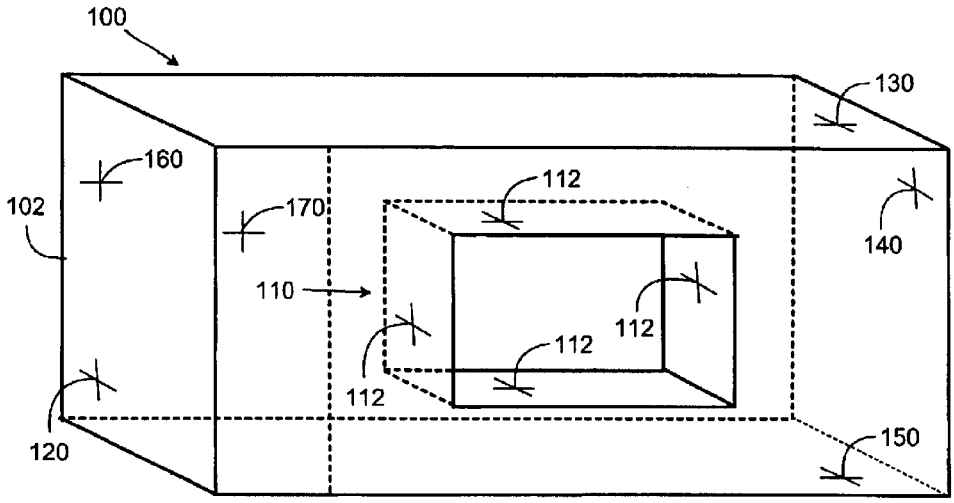

The invention relates to a dielectric double-mode resonator used in radio-frequency filters.

BACKGROUND

High-frequency filters, such as radio-frequency filters, are used to implement high-frequency circuits in the base stations of mobile networks, mobile phones and other radio transceivers. Possible radio-frequency filter applications include the adapter circuits and filter circuits of transmitter and receiver amplifiers.

In telecommunications applications in particular, good performance in a desired operating range, temperature stability and a small size are required of radio-frequency filters. These properties can be achieved using dielectric resonators, the frequency properties of which, such as the resonance frequency, can be influenced by the structure of the resonator, the physical dimensions of the resonator and the resonator material, for instance.

The operation of a dielectric resonator is based on the reflection of electromagnetic waves from the boundary between a material having a high dielectric constant and a material having a low dielectric constant, such as air. A simple dielectric resonator is formed of a disc-like structure made of dielectric material, whose outer sheath and the air surrounding the outer sheath form a boundary reflecting electromagnetic waves. The disc-like structure can be replaced by a thick planar structure, in which the thickness of the plane is in the same range as the lengths of the sides of the plane. The structures described above can be used to form a typical one-mode resonator that produces as its first mode the $TE_{01\delta}$ resonance mode, also called basic mode, that is produced when a radio-frequency electromagnetic field is directed to the resonator.

The disc-like structure is typically made by compressing powdery ceramic material into a desired form in a mould, after which the compressed article is sintered at a high temperature.

The size of a high-frequency filter can be significantly reduced using a double-mode resonator as the resonating element. A double-mode resonator has two primary modes and secondary modes, the resonances of the primary modes being utilized in a high-frequency filter and the impact of the secondary modes being eliminated by external filters, for instance. The resonance modes can be generated for instance by combining two one-mode resonators in such a manner that a connection is established between the one-mode resonators. The connection is established for instance by means of two substantially similar disc-like structures, in which the discs are positioned crosswise. The double-mode resonator is then formed of two structural resonators, each of which functions unconnected as a separate resonator, but which can have common structural parts. This type of double-mode resonator can be made in the same manner as a one-mode resonator, but a drawback of the obtained double-mode resonator is a poor separation of the secondary modes from the primary mode of the filter, which has a weakening effect on the frequency response of the filter. The separation of the primary modes from the secondary modes can be improved substantially by making openings in the disc-like structure, whereby an empty space is formed between the crosswise-positioned disc-like structures. The manufacturing of a double-mode resonator of this kind is, however, not possible by one-stage compression molding, and complex milling techniques are required.

In prior-art solutions, the above double-mode resonator equipped with an empty space is formed of three parts in such a manner that one of the structural resonators of the double-mode resonator is formed of a uniform disc-like structure having an opening and the other structural resonator is formed by joining side sections to the sides of the uniform disc-like structure to form the side walls of the opening of the second structural resonator. The first structural resonator is then formed of the uniform disc-like structure having an opening and the second structural resonator is formed of a total of three parts: two side sections and a section of the uniform disc-like structure.

In one prior-art solution, the double-mode resonator is formed of two structural resonators that differ from each other, the difference being caused by the structures of the parts forming the double-mode resonator: the first structural resonator is made up of a uniform structure, whereas the second structural resonator comprises three parts having boundaries between them that separate the second resonator and affect the frequency response of the second resonator. The frequency response of the double-mode resonator is then very sensitive to errors occurring during the installation of the parts and to the effects of the fastening mechanism of the parts.

BRIEF DESCRIPTION

It is an object of the invention to implement a dielectric double-mode resonator in such a manner that the manufacturing of the double-mode resonator becomes simple and reliable.

This is achieved by a dielectric double-mode resonator of a radio-frequency filter that comprises a block structure comprising at least two resonator structures, each having at least one resonance mode, the block structure also comprising a cavity wall limiting a cavity at least partly inside the block structure and the cavity affecting the resonance modes of the at least two resonance structures. The block structure of the dielectric double-mode resonator of the invention comprises, set against each other: a first block that comprises at least part of the at least two resonator structures and at least part of the cavity wall, and a second block that comprises at least part of the at least two resonator structures and at least part of the cavity wall.

Preferred embodiments of the invention are set forth in the dependent claims.

The invention is based on the fact that the dielectric double-mode resonator is formed of the two pre-compression-molded and sintered blocks, each comprising at least part of two resonator structures and at least part of the cavity wall of the double-mode resonator. The use of two blocks forms a significant manufacturing engineering advantage in relation to the prior art, because the invention streamlines the assembly of the double-mode resonator. In addition, operational advantages of the double-mode resonator are achieved, because the boundaries between the blocks affect homogeneously the frequency properties of both resonator structures, whereby said boundaries mainly affect the resonance frequencies, but the impact on the coupling of the resonance modes is low.

LIST OF FIGURES

Figure 2A:
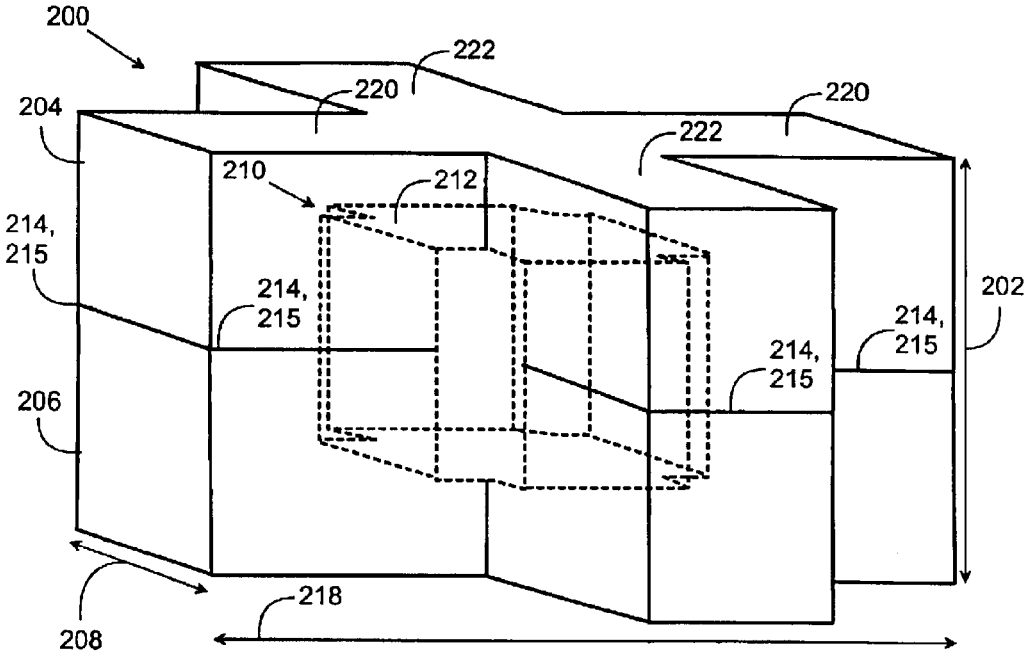
Figure 2B:
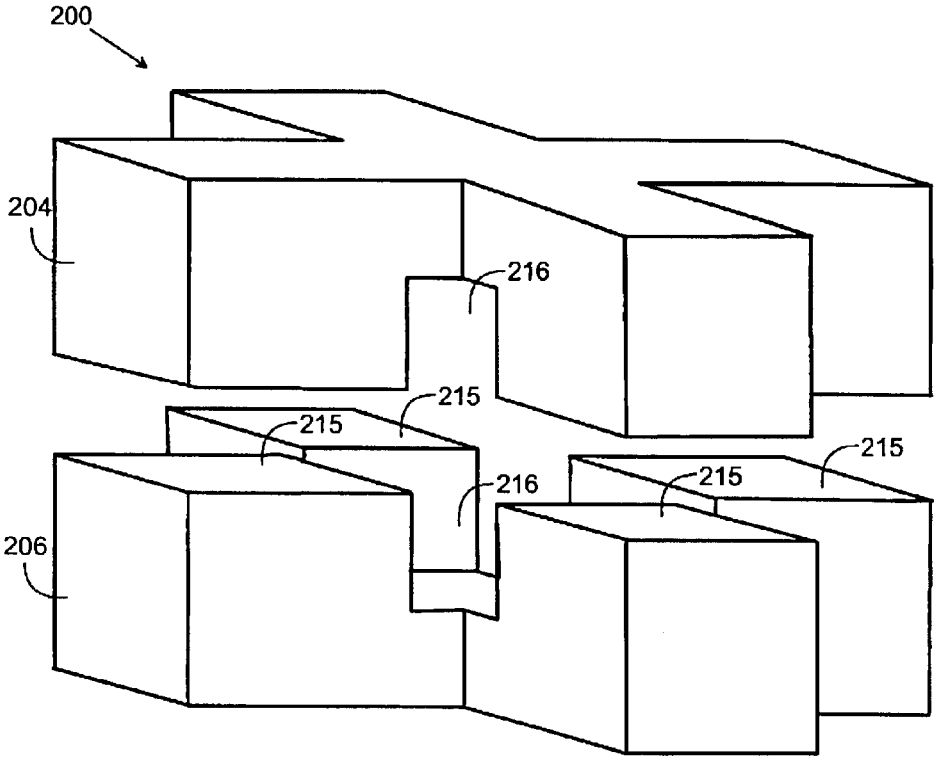
Figure 2C:
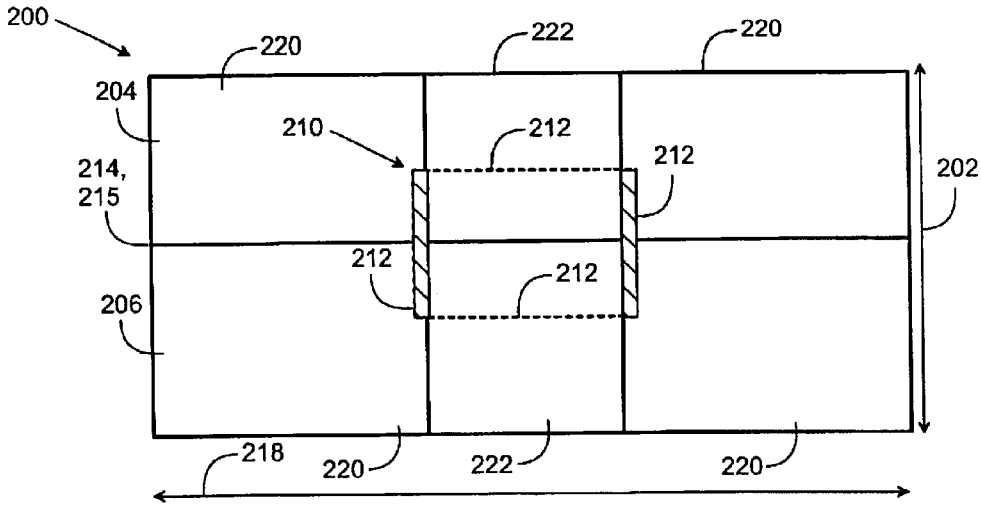
Figure 2D:
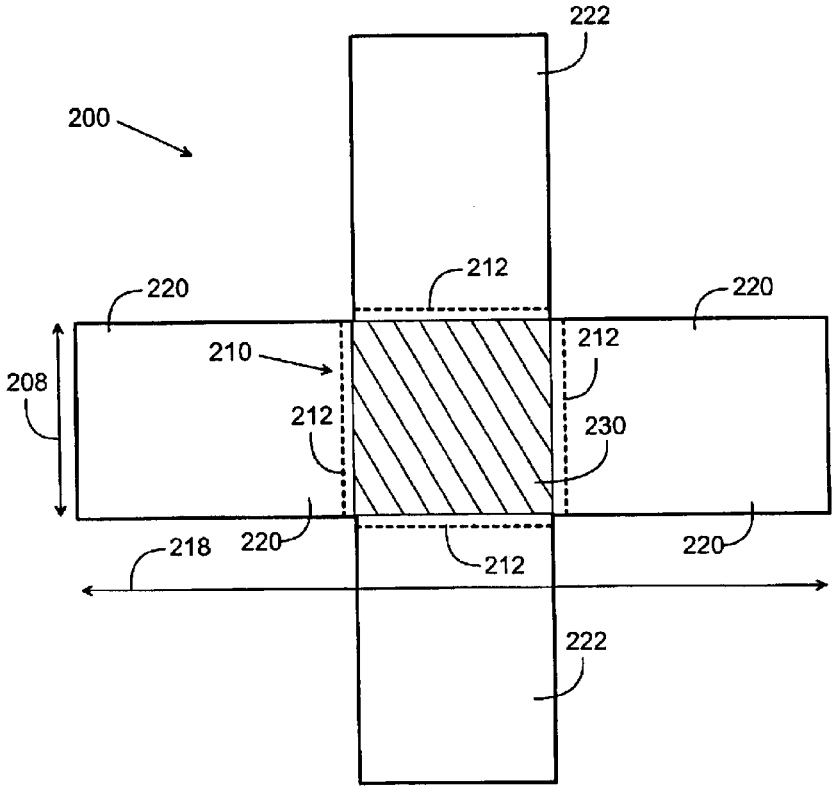
Figure 2E:
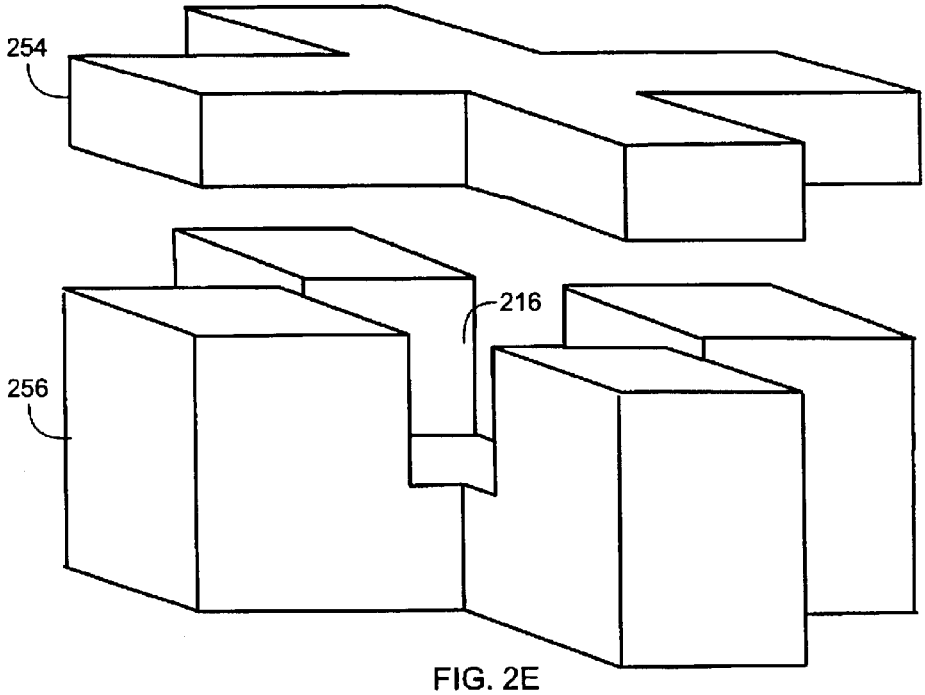
Figure 2F:
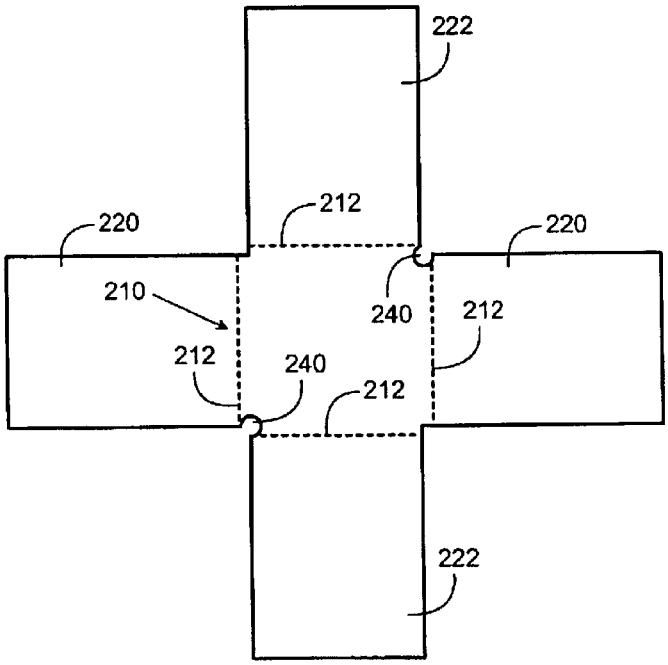
Figure 2G:
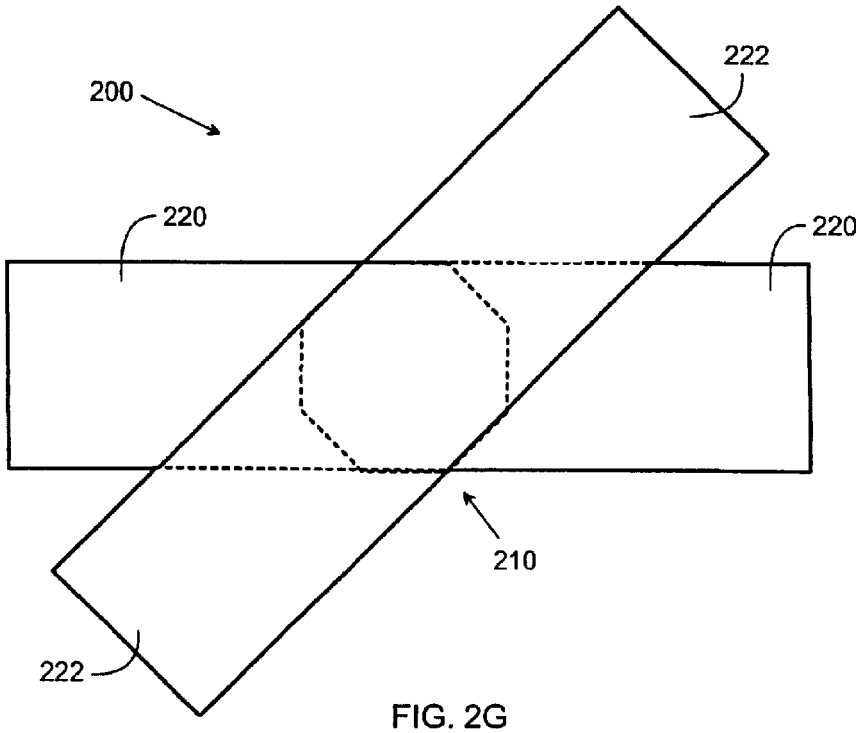
Figure 2H:
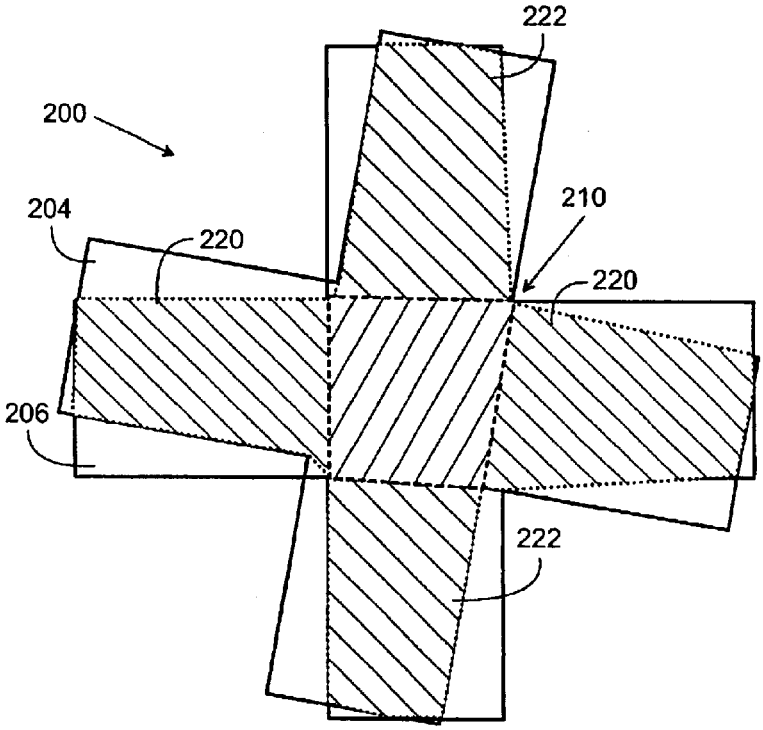
Figure 2I:
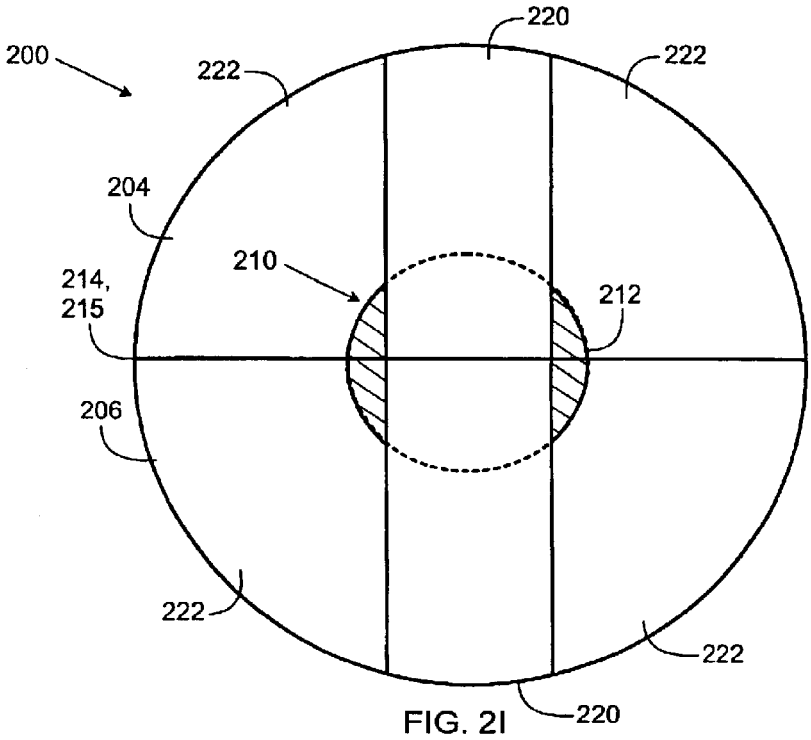
Figure 2J:
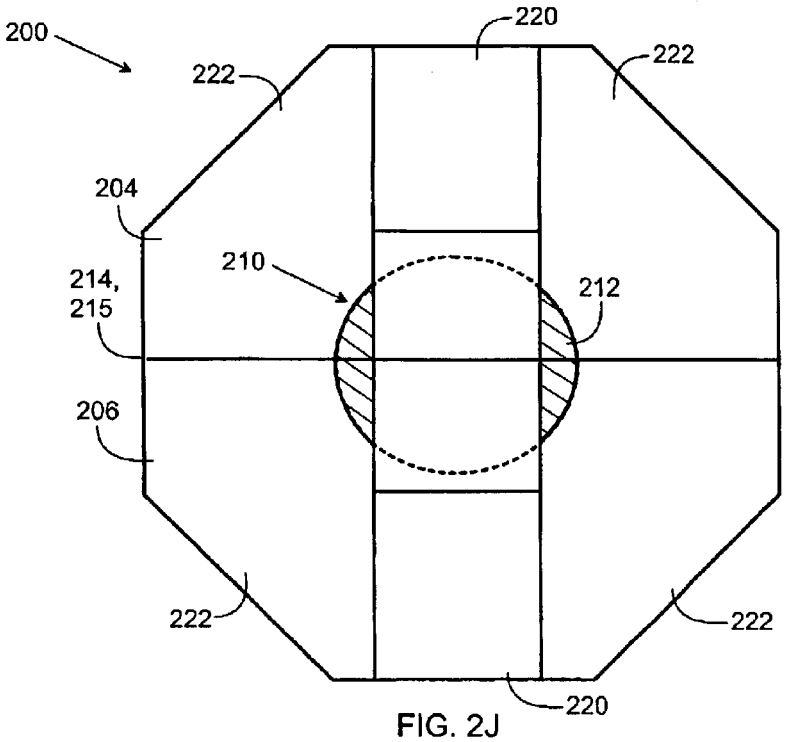
Figure 3A:
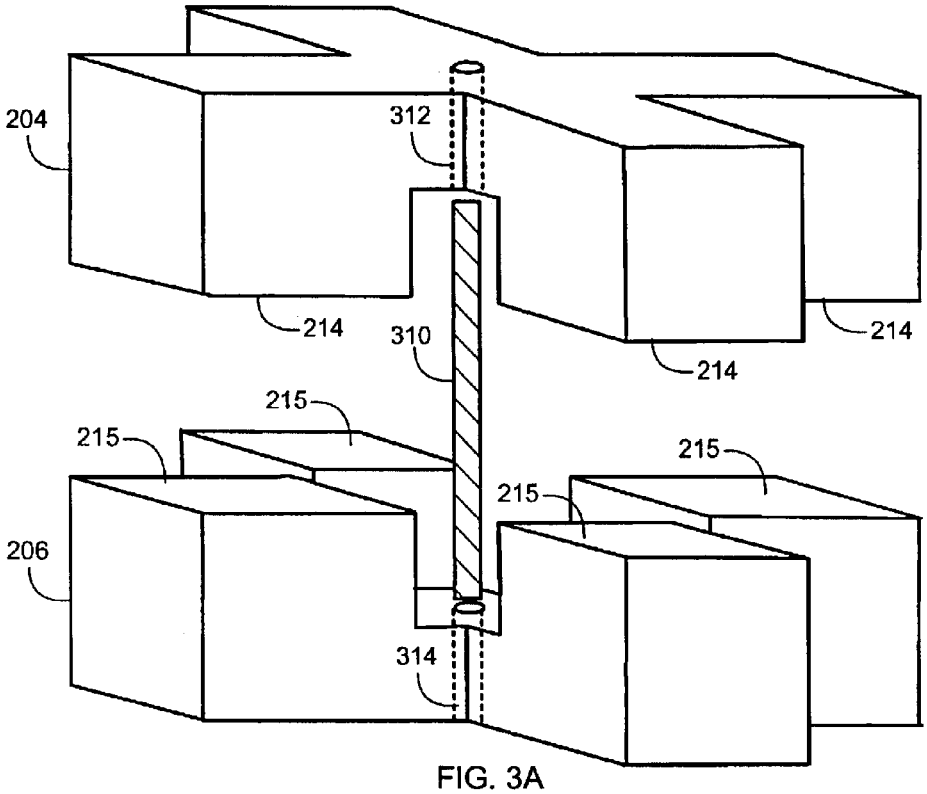
Figure 3B:
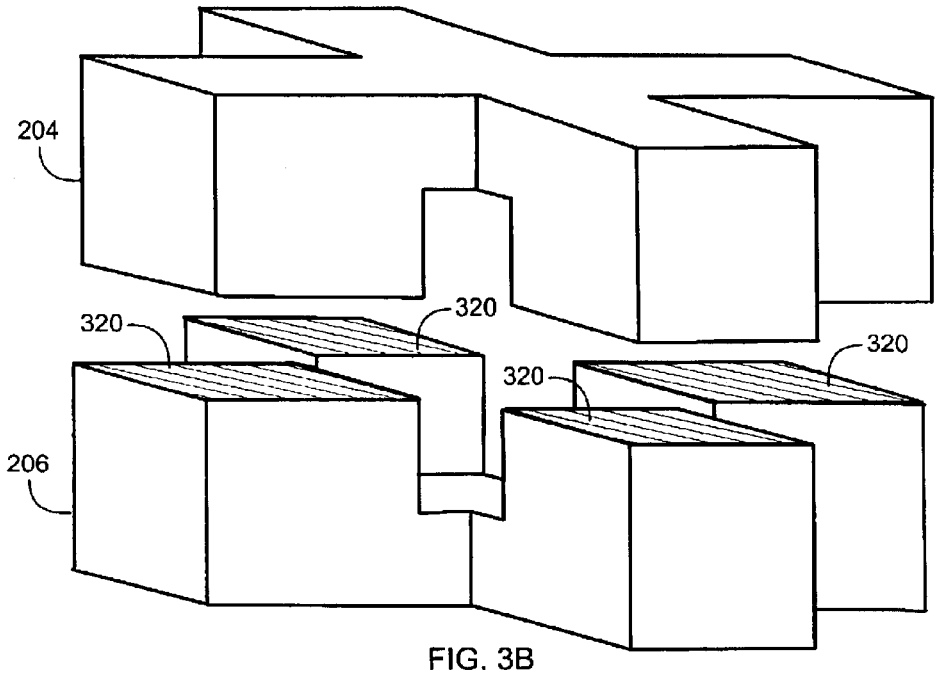
Figure 4A:
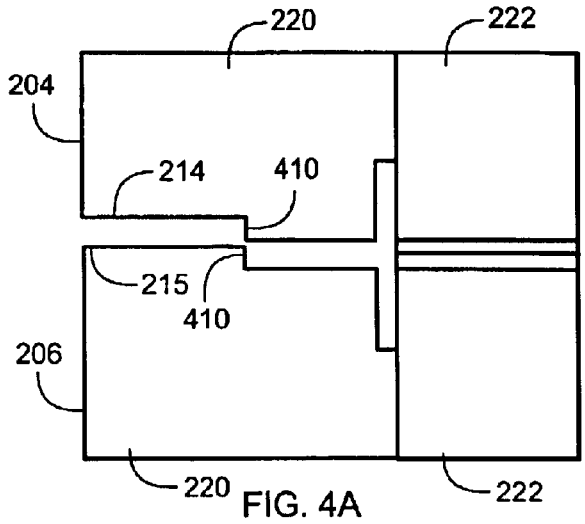
Figure 4B:
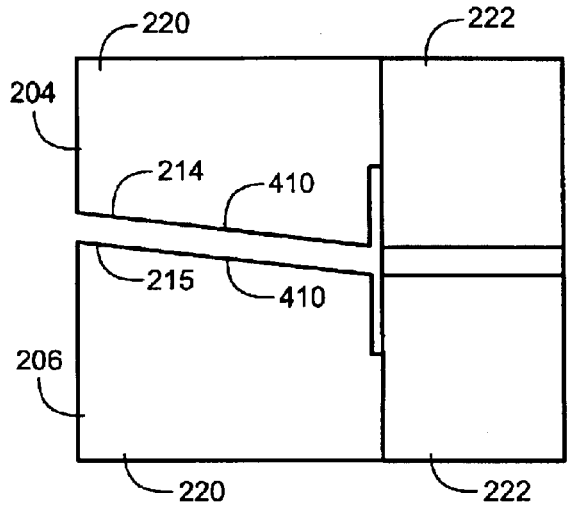
Figure 4C:
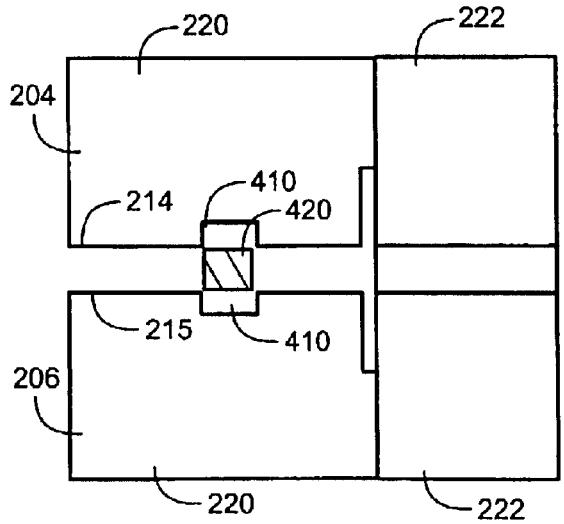
Figure 5A:
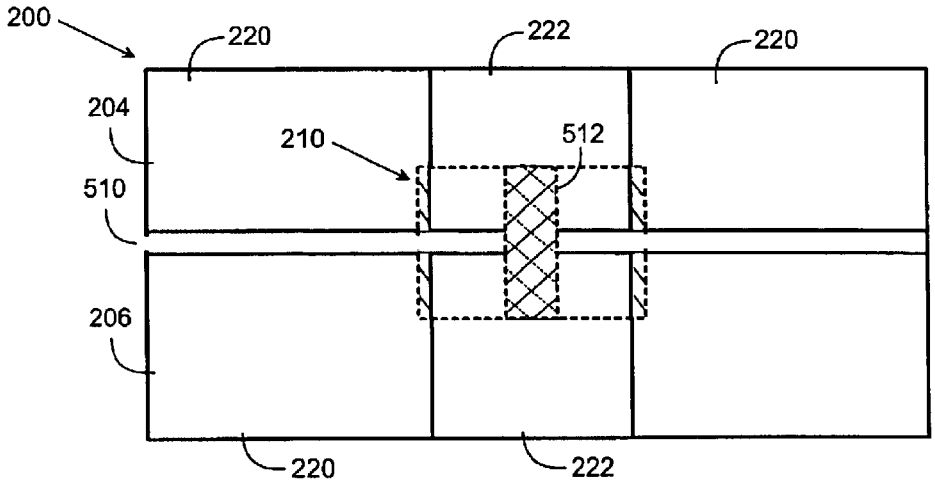
Figure 5B:
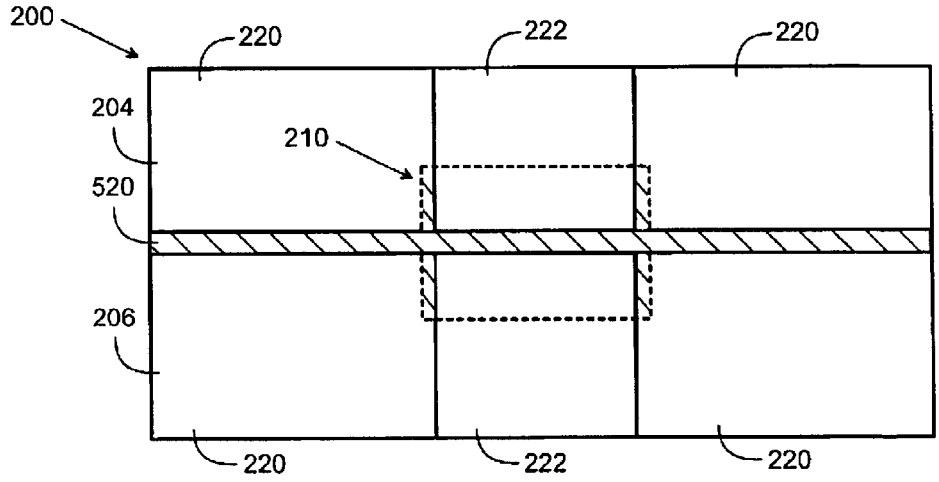
Figure 6A:
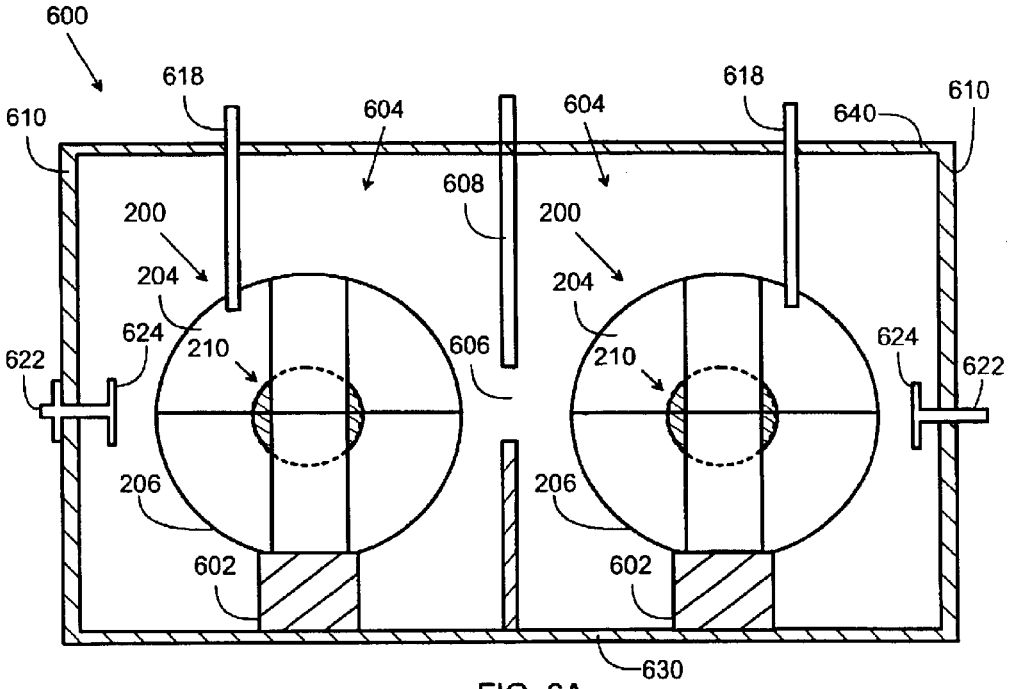
Figure 6B:
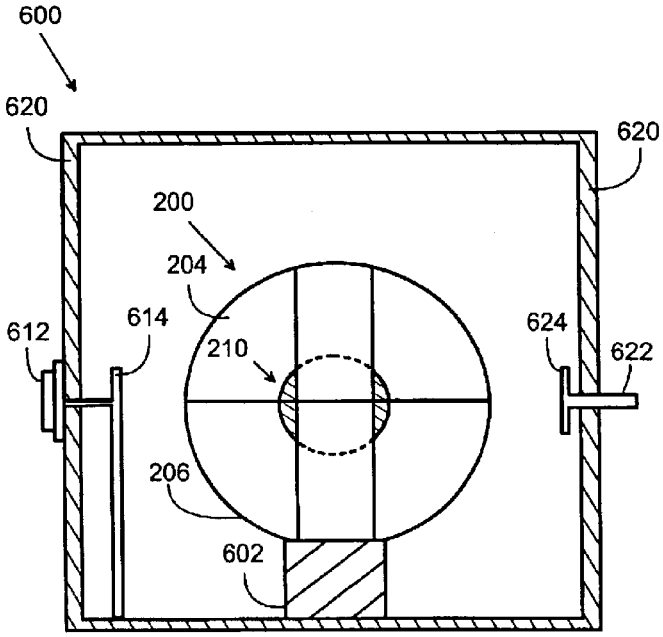
Figure 6C:
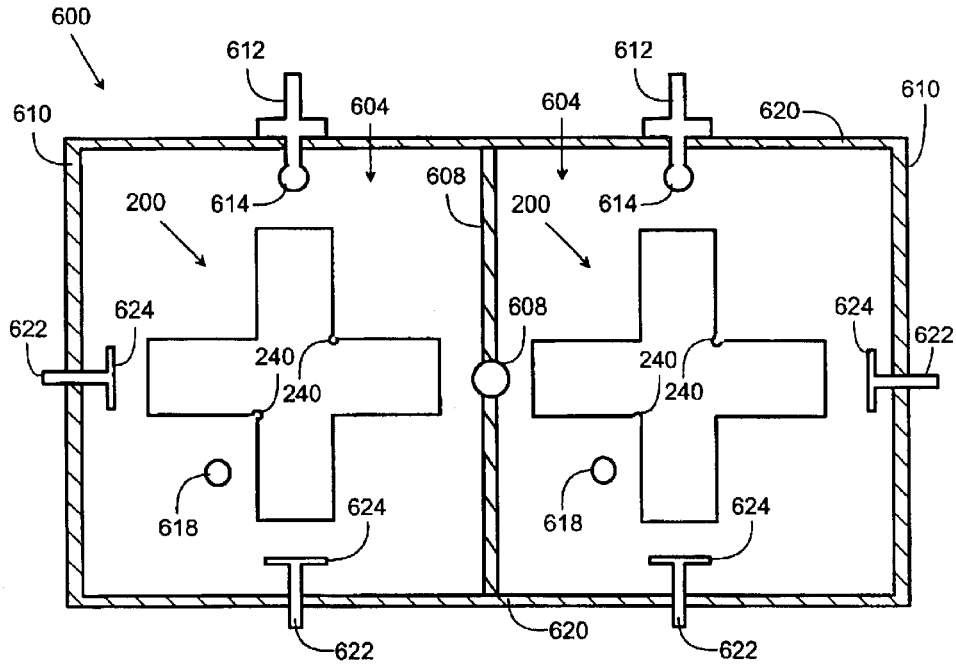

The invention will now be described in more detail by means of preferred embodiments and with reference to the attached drawings, in which FIG. 1 shows a dielectric one-mode resonator, FIG. 2A is a perspective view of a block structure of a dielectric double-mode resonator, FIG. 2B shows one embodiment for forming the block structure of a dielectric double-mode resonator, FIG. 2C is a side view of a block structure of a dielectric double-mode resonator, FIG. 2D is a top view of a second block structure of a dielectric double-mode resonator, FIG. 2E shows a second embodiment for forming the block structure of a dielectric double-mode resonator, FIG. 2F shows an embodiment for connecting the resonance modes of the resonator structures of a dielectric double-mode resonator, FIG. 2G shows a second embodiment for connecting the resonance modes of the resonator structures of a dielectric double-mode resonator, FIG. 2H shows an embodiment for setting the frequency response of a dielectric double-mode resonator, FIG. 2I is a side view of a block structure of a dielectric double-mode resonator, FIG. 2J is a side view of a second block structure of a dielectric double-mode resonator, FIG. 3A shows an embodiment for positioning blocks, FIG. 3B shows a second embodiment for positioning blocks, FIG. 4A shows an embodiment for shaping fastening surfaces, FIG. 4B shows a second embodiment for shaping fastening surfaces, FIG. 4C shows a third embodiment for shaping fastening surfaces, FIG. 5A shows an embodiment for setting the frequency response of a dielectric double-mode resonator, FIG. 5B shows a second embodiment for setting the frequency response of a dielectric double-mode resonator, FIG. 6A is a side view of a dielectric double-mode resonator in a band-pass filter, FIG. 6B is an end view of a dielectric double-mode resonator in a band-pass filter, FIG. 6C is a top view of a dielectric double-mode resonator in a band-pass filter.

DESCRIPTION OF THE EMBODIMENTS

Let us first examine an annular dielectric resonator 100 having an opening according to the prior art as shown in FIG. 1, which resonator 100 comprises a main block 102 made of dielectric material and comprising side walls 120, 130, 140, 150 and end walls 160, 170. In addition, the resonator 100 comprises an opening 110 for adjusting the frequency properties of the resonator 100, the opening 110 being formed between the end walls 160, 170 and the boundary between the opening 110 and the main block 102 forming the walls 112 of the opening 110. A resonator ring is formed by the dielectric material around the opening 110. The opposing walls 120, 140 and 130, 150 of the side walls are usually parallel with each other, whereby the main block 102 forms a hollow rectangular structure. The angles between the side walls 120, 130, 140, 150 can also be rounded, whereby the walls 120, 130, 140, 150 form a cylindrical outer surface of the main block. The end walls 160, 170 are preferably parallel and the distance between them is typically less than half of the used wavelength of the electromagnetic field. The resonator 100 has one primary resonance mode that is generated when a radio-frequency electromagnetic field is directed to the resonator 100.

Let us next examine the preferred embodiments of a double-mode resonator used in a radio-frequency filter by means of examples and figures.

FIGS. 2A, 2C and 2D show an example of the block structure 200 of a double-mode resonator, which is formed by setting a first block 204 and second block 206 similar to those in FIG. 2B against each other. FIGS. 2A, 2C and 2D show the block structure 200 of a dielectric double-mode resonator comprising two resonator structures 220, 222 which as separate and unconnected resonators resemble in structure the resonator 100 shown in FIG. 1, but which in a double-mode resonator possibly comprise common structural parts. The resonator structures 220, 222 are structures of the double-mode resonator, whose frequency response generated in the double-mode resonator corresponds to the frequency response which would be obtained by connecting the resonance modes of fully separate resonator structures 220, 222 with an equal coupling. Even though the resonator structures 220, 222 comprise common structural parts of the dielectric double-mode resonator and the impact of the separate resonator structures 220, 222 on the properties of the double-mode resonator cannot entirely be distinguished from each other, the resonator structures 220, 222 are examined as separate entities for the sake of simplicity.

In one embodiment, the resonator structures 220, 222 are crosswise, whereby a crossing area 230 is formed at the point of contact of the resonator structures 220, 222. The cavity 210 is then located substantially at the crossing area 230 of the resonator structures 220, 222. In one embodiment, the resonator structures 220, 222 are substantially perpendicular to each other. The perpendicularity can be defined structurally, whereby the resonator structures 220, 222 are physically perpendicular to each other. The perpendicularity can also be defined functionally, whereby the perpendicularity criterion is met when there is no connection between the resonance modes of the resonator structures 220, 222 without a separate coupling arrangement.

The blocks 204, 206 comprise fastening surfaces 214, 215 that settle substantially against each other when the block structure 200 is formed. There may be other material than the resonator material between the fastening surfaces 214, 215. When the blocks 204, 206 are set against each other, a cavity 210 is formed between them and its cavity wall 212 is adjacent to the block structure 200. According to the disclosed solution, each block 204, 206 forms at least part of each resonator structure 220, 222 in such a manner that each block 204, 206 comprises at least part of the cavity wall 212 of the cavity 210.

The block structure 200 of the dielectric double-mode resonator according to the disclosed solution can be formed by several different means depending on the location of the fastening surfaces 214, 215 between the blocks 204, 206 in the blocks 204, 206.

With reference to FIG. 2B, in one embodiment, the fastening surfaces 214, 215 are located substantially in the middle of the block structure 200 and divide the block structure 200 into two similar sections, thus making the first block 204 and the second block 26 substantially similar. Both blocks 204, 206 then form a cup-like structure comprising a cavity 216 that substantially forms half of the cavity 210 when the blocks 204, 206 are set against each other. In this embodiment, each block 204, 206 comprises substantially half of each resonator structure 220, 222. The similarity of the blocks 204, 206 also provides a manufacturing advantage, because then during the compression-molding stage, only one type of mould is required to compression-mould both blocks 204, 206. At the same time, physical symmetry is achieved for the double-mode resonator. In double-mode resonators formed of similar or nearly similar blocks 204, 206, each resonator structure 220, 222 is formed of two symmetrical or nearly symmetrical sections, which provides a physical homogeneity in the resonator structures 220, 222, such as even thickness 208, even width 218 and even height 202. Physical homogeneity provides the advantage of good predictability of the frequency properties of the dielectric double-mode resonator, for instance.

With reference to FIG. 2E, in a second embodiment of the block structure 200, the first block 254 serves as the cover part of the block structure 200 and the second block 256 as the cup part. The cover part 254 then comprises at least part of both resonator structures 220, 222 and at least part of the cavity wall 212 of the cavity 210. The cup part 256, in turn, comprises the cavity 216 that forms the cavity 210 when the cover part 254 and cup part 256 are set against each other. An advantage of this embodiment is that in some cases, it is technically more advantageous to make one easily manufactured cover part 254 and one slightly more difficult cup part 256 than two cup parts.

The frequency properties of the dielectric double-mode resonator can be controlled by means of the dielectric constant $\in_r$ of the block structure 200 material, the shape of the double-mode resonator, the physical dimensions of the block structure 200 and the size and shape of the cavity 210. The value of the dielectric constant $\in_r$ of the block structure 200 material can be 1 to 200. The dielectric constant of the opening 210 material is typically considerably smaller than the dielectric constant of the main block, for instance 1. In one embodiment, the block structure 200 comprises mainly ceramic material, such as barium titan oxide ($Ba_2Ti_9O_{20}$), having $\in_r$=40.

Let us next examine the operation of a double-mode resonator made up of the block structure described above. In one embodiment, the resonance modes of the first 220 and second 222 one-mode resonator structure of the dielectric double-mode resonator are inter-connected. The one-mode resonator structures 220, 222 have one primary resonance mode that the one-mode resonator structure 220, 222 produces when a radio-frequency electromagnetic field is directed to it. Especially in the case of a $TE_{01\delta}$ double-mode resonator, the first one-mode resonator structure is the part of the double-mode resonator structure that produces the first $TE_{01}$ mode and the second one-mode resonator structure is the part of the double-mode resonator that produces the second primary $TE_{01}$ resonance mode. With the inter-coupling of the resonance modes of the one-mode resonator structures 220, 222, the primary resonance mode of the first one-mode resonator structure 220 is connected with the primary resonance mode the second one-mode resonance structure 222, whereby the frequency response of the inter-connected one-mode resonator structures 220, 222 corresponds to the frequency response, which would be obtained by connecting completely separate one-mode resonators with an equal coupling. A suitable connection to a filter using TE double-mode resonators produces desired properties, such as the passbandwidth in a band-pass filter.

In one embodiment, the dielectric double-mode resonator 200 comprises coupling means for forming the connection between the resonance modes of the resonator structures 220, 222.

The coupling means may be an irregularity factor that breaks the symmetry between the resonator structures 220, 222. The coupling means can be for instance a groovelike structure according to FIG. 2F that extends substantially to both blocks 204, 206 and resides close to the crossing area of the resonator structures 220, 222.

The inter-coupling of the resonance modes of the resonator structures 220, 222 and the setting of the frequency response can also be performed by means of the structure of the dielectric double-mode resonator. In one embodiment, the resonator structures 220, 222 form a slanted cross-structure to form the inter-coupling of the resonance modes of the resonator structures 220, 222. The resonator structures 220, 222 then form a cross-structure in the shape of a slanted letter X according to FIG. 2G and the inter-coupling of the resonance modes of the resonator structures 220, 222 is strengthened as the parallelism of the resonators 220, 222 increases. In another embodiment, the frequency response of the dielectric double-mode resonator is adjusted by setting the first block 204 and the second block 206 against each other in such a manner that the first block 204 is turned in relation to the second block 206. This produces the configuration of the blocks 204, 206 shown in FIG. 2H, in which the blocks 204, 206 partly overlap each other, and the overlapping parts of the blocks 204, 206 form the actual resonator structure.

The two-mode resonator has two resonance modes. In one embodiment, the dielectric double-mode resonator is a TE (Transfer Electric) double-mode resonator, in which the primary mode is a $TE_{01}$ mode and the closest secondary mode is typically a TM-type mode. The double-mode resonator is usually configured in such a manner that desired primary mode properties, such as the resonance frequencies and the inter-coupling of the resonance modes, are obtained, and the impact of the secondary modes on the operation of the primary mode are minimized. The Q value of the primary mode depends on the frequency; a typical Q value is 20,000 when the frequency is 2 GHz. One way of controlling the secondary modes is to form the above-mentioned cavity 210 into the block structure 200, whereby the resonance frequencies of the closest secondary modes move upwards on the frequency scale, enabling an efficient secondary mode filtering by a low-pass filter, for instance. It is essential for the operation of the cavity that the dielectric constant of the cavity 210 is substantially smaller than that of the block structure 200. This way, the frequency band of the secondary modes moves further away from the frequency band of the primary modes, which enables an efficient filtering of the secondary modes from the actual radio-frequency filter with external filters. For instance, if the cavity 210 is filled with air, the dielectric constant of the cavity 210 is 1.

FIGS. 2A to 2E refer to the basic structure of a double-mode resonator that does not in any way restrict the shape and size of the double-mode resonator of the disclosed solution. In one embodiment, the block structure 200 of the double-mode resonator comprises two rectangular resonator structures 220, 222. The block structure of the double-mode resonator is then as described in FIG. 2A. In a second embodiment, the block structure 200 of the double-mode resonator comprises two cylindrical resonator structures 220, 222 according to FIG. 2I. In yet another embodiments, the resonator structures 220, 222 are polygons, such as the octagon shown in FIG. 2J.

As seen from above, the block structures 200 of FIGS. 2A, 2F and 2G shown from the side can form any of the cross-structures shown in FIG. 2D, 2H or 2G. Regardless of the shape, the blocks 204, 206 can be formed from the above-mentioned nearly similar blocks or the cup part-cover part blocks 254, 256. The height 202 of the double-mode resonator is typically in the same range as its width 218, and the thicknesses 208 of the resonator structures 220, 222 are approximately a third of the width 218.

To form a block structure 200 of the desired type, the blocks 204, 206 must be positioned correctly with respect to each other. FIGS. 3A and 3B show some embodiments for the formation of the block structure 200. In the embodiment shown in FIG. 3A, the dielectric double-mode resonator comprises fastening elements 310, 312, 314 for forming the block structure from the blocks 204, 206. The blocks 204, 206 are positioned with the fastening elements 310, 312, 314 in such a manner that the fastening surfaces 214, 215 meet at least partly. There may be a material or air between the fastening surfaces 214, 215. The fastening elements 310, 312, 314 can reside inside the block structure or outside it. An external fastening element can be clamp-like, in which case the fastening element presses the blocks 204, 206 against each other. An internal fastening element 310 can be pin-like, forming a mechanical fastening between the blocks 204, 206. In one embodiment, the pin-like element 310 penetrates the cavity 210. In another embodiment, the fastening element 310 penetrates at least one fastening surface 214, 215 of the blocks 204, 206. The fastening elements 312, 314 are counterparts to the fastening element 310 that reside in the blocks 204 and 206, to which the fastening element 310 fastens. The counterparts 312, 314 can be openings, for instance, made in the blocks 204, 206 for fastening and having grooved walls or a threaded structure. The surface of the fastening element 310 then preferably also has a groove or thread that matches the surface profile of the counterparts 312, 314. In one embodiment, the fastening element 310 is a fixed part of the first block 204, in which case only the second block 206 comprises the counterpart 312, 314 described above. In one preferred embodiment, the manufacturing material of the fastening elements 310, 312, 314 is selected in such a manner that the impact of the fastening elements on the frequency properties of the dielectric double-mode resonator is as insignificant as possible. The parts of the fastening element 310 that enter the blocks 204, 206 should then preferably be made of a material that has the same or nearly the same dielectric constant as the material of the blocks 204, 206. Correspondingly, the part of the fastening element that is in the cavity 210 should preferably be made of a material having the same dielectric constant as the cavity material. For instance, if the cavity 210 consists of air, the dielectric constant of the part of the fastening element inside the cavity should preferably be close to one.

In a second embodiment according to FIG. 3B, the dielectric double-mode resonator comprises a binding agent 320 for fastening the blocks 204, 206 to each other. The binding agent is typically a low-loss dielectric agent that forms a binding layer between the surfaces 214, 215 and fastens the blocks 204, 206 to each other.

In one embodiment, the blocks 204, 206 are positioned by silver-sintering. In silver-sintering, a thin silver layer in the range of 10 $\mu$m is formed by heating between the blocks 204, 206 to act like glue and to fasten the blocks 204, 206 to each other.

In one embodiment, the dielectric double-mode resonator comprises positioning means 410, 420 for positioning the blocks 204, 206 accurately with respect to each other when forming the block structure 200. FIG. 4A shows a solution, in which the fastening surfaces 214, 215 of the blocks 204, 206 have notches 410, whereby the fastening surfaces 214, 215 form a step-like structure. In FIG. 4B, the fastening surfaces of the blocks 204, 206 in turn form a slanted structure. FIG. 4C shows a solution, in which dents 410 are formed in the fastening surfaces of the blocks 204, 206 to form a cavity-like structure between the fastening surfaces 214, 215 when the blocks 204, 206 are set against each other. A piece 420 made of dielectric material, for instance, can be fitted into the dent 410, in which case the piece 420 and dent 410 together position the blocks 204, 206 to each other.

The presented solution makes it possible to set the frequency of the dielectric double-mode resonator after the mould-casting and sintering stages, and it can be done before or after the double-mode resonator is placed in its operating environment, such as the casing of the radio-frequency filter. The presented solution enables the setting of the frequency in such a manner that the frequency properties of both resonator structures 220, 222 of the double-mode resonator are affected in the same manner, in which case the frequency adjustment affects mainly the resonance frequencies and less the inter-coupling of the primary modes. The frequency setting comprises modifying the frequency response curve of the dielectric double-mode resonator by altering the physical properties of the double-mode resonator. In one embodiment, the dielectric double-mode resonator comprises frequency-setting means for setting the frequency response of the double-mode resonator. The frequency-setting means are used at the formation stage of the block structure 200 to adjust the effective distance between the blocks 204, 206, which effective distance depends not only on the physical distance between the blocks 204, 206, but also on the properties of the material between the blocks 204, 206. With the frequency-setting means, the frequencies of the primary modes of the double-mode resonator can be moved typically 10% to the desired direction. At the same time, the frequencies of the secondary modes typically also change. The secondary modes are typically made 1.5 times the frequencies of the primary modes, which makes it possible to filter them with low-pass filters, for example. With reference to FIG. 5A, in one embodiment, the dielectric double-mode resonator comprises a support 512 supporting the blocks 204, 206 for setting the frequency response of the dielectric double-mode resonator, by means of which support 512 a gap 510 is formed between the blocks 204, 206 and the size of the gap can vary between 0 and 25% of the height of the double-mode resonator. FIG. 5A shows one embodiment of the support 512, in which the support 512 penetrates the cavity 210 and positions the blocks 204, 206 in such a manner that a gap 510 is formed between the blocks. The support 512 can be part of the fastening element 310 or the fastening element 310 can be partly inside the support 512. In one embodiment, the support 512 is a pin-like piece, the ends of which penetrate the blocks 204, 206 and the arm of which has stoppers that settle against the cavity 210 walls restricting the distance between the blocks 204, 206 and forming a gap 510 between the blocks 204, 206. In one preferred embodiment, the support is made of a low-loss dielectric material, such as aluminum oxide $Al_2O_3$.

In another embodiment, the dielectric double-mode resonator comprises an insulating layer 520 between the blocks 204, 206 for setting the frequency response. The insulating layer 520 works in the same manner as the gap between the blocks 204, 206, but the support 512 is then not necessary, because the insulating layer 520 can support the blocks 204, 206. The insulating layer 520 can have an opening at the cavity 210 in such a manner that the insulating layer 520 does not penetrate the cavity 210. The insulating layer 520 is typically made of a material having a low-loss dielectric constant. The dielectric constant of the insulating material is substantially lower than the dielectric constant of the block structure 200, as the dielectric constant $\in_r$ varies between 1 and 10.

In telecommunications applications in particular, radio-frequency filters are required to efficiently filter desired radio frequencies. In one embodiment, the dielectric double-mode resonator operates in a band-pass filter. The pass-band is then obtained for the filter by defining the resonance frequencies of the structural one-mode resonators 220, 222 and their inter-couplings as desired. Let us examine by means of FIGS. 6A to 6C the use of a dielectric double-mode resonator in a four-pole TE-mode band-pass filter. The band-pass filter 600 comprises the block structure 200 of the dielectric double-mode resonator according to the presented solution. In addition, the band-pass filter comprises a casing 600 made of conductive material, such as aluminum, and the casing in turn comprises end parts 610, side parts 620, a bottom part 630 and cover part 640. The side view 6A shows that the casing 600 comprises at least one compartment 604 with a coupling opening 606 for making the coupling between the double-mode resonators 200 residing in adjacent compartments 604.

The dielectric double-mode resonator comprises in each compartment 604 a base 602, on which the block structure 200 according to the presented solution is placed. The base 602 is preferably made of a low-loss dielectric material, such as aluminum oxide ($Al_2O_3$).

The band-pass filter comprises connectors 612 for connecting the band-pass filter to an external source and the band-pass filter filters the radio signal coming from the external source. The connectors 612 are preferably placed in the side parts 620 of the casing 600. Each connector 612 connects to a connecting pin 614 inside the casing 600, and a radio signal led through the pin to the band-pass filter directs an electromagnetic field to the double-mode resonator and the casing 600 walls surrounding it. The connecting pin 614 can be galvanically coupled to the casing 600, but a short-circuit is, however, not created on radio frequencies.

In addition to the above-mentioned block structure-specific frequency setting means and coupling means the band-pass filter can also comprise casing-specific coupling adjustment means 608, 618 and frequency adjustment means 624 for adjusting the properties of the band-pass filter. Frequency adjustment can be based on altering the inter-coupling of the resonators 220, 222, altering the inter-coupling of the double-mode resonators residing in different casings 600, and altering the coupling between each double-mode resonator and the casing structure surrounding it.

The coupling between the resonator structures 220, 222 can be made using coupling grooves 240 in the block structure 200. In addition to this, the casing comprises coupling brackets 618 for making the coupling between the resonators 220, 222 and possibly for adjusting the coupling. The coupling brackets 618 are typically fastened to the bottom part 630 or cover part 640 of the casing structure 600. In one embodiment, the coupling bracket 618 penetrates the cover part 640 of the casing structure, in which case the length of the coupling bracket 618 in the section inside the casing 600 can be adjusted from outside the casing by means of a thread of the coupling bracket 618, for instance, when the casing is closed.

In one embodiment, the band-pass filter comprises adjusting elements 608 used to adjust the connection made through the opening 606 between the double-mode resonators 200 residing in different compartments 604. In one embodiment, the adjusting element 608 comprises a screw or pin that penetrates the wall of the casing 600, enabling the adjustment of the opening 606 from the outside when the casing is closed.

In one embodiment, the band-pass filter comprises an adjustment flange 624 for adjusting the frequency of the resonator structures 220, 222 of the double-mode resonator. The flange 624 is positioned in the casing in such a manner that the side of the flange is parallel or nearly parallel with at least one end wall 160, 170 of the resonator structure 220, 222 and the flange 624 is at the same height or nearly the same height as the cavity 210 of the double-mode resonator. In one embodiment, the flange 624 is fastened to a flange support 622 penetrating the side or end walls of the casing 600, the support being a screw or a grooved pin, for instance. The distance of the flange from the resonator structure 220, 222 can then be adjusted outside the casing 600 when the casing is closed.

Even though the invention has been explained in the above with reference to an example in accordance with the accompanying drawings, it is apparent that the invention is not restricted to it but can be modified in many ways within the scope of the inventive idea disclosed in the attached claims.

What is claimed is:

1. A dielectric double-mode resonator of a radio-frequency filter that comprises a block structure comprising at least two resonator structures, each having at least one resonance mode, the block structure also comprising a cavity wall limiting a cavity at least partly inside the block structure and the cavity affecting the resonance modes of the at least two resonance structures, wherein the block structure comprises, set against each other:

a first block that comprises at least part of the at least two resonator structures and at least part of the cavity wall, and a second block that comprises at least part of the at least two resonator structures and at least part of the cavity wall.

2. The dielectric double-mode resonator as claimed in claim 1, wherein the dielectric double-mode resonator comprises a primary resonance mode of the first one-mode resonator structure and a primary resonance mode of the second one-mode resonator structure that are inter-coupled.

3. The dielectric double-mode resonator as claimed in claim 1, wherein the resonator structures are crosswise, whereby a crossing area is formed at the point of contact of the resonator structures.

4. The dielectric double-mode resonator as claimed in claim 1, wherein the at least two resonator structures are substantially perpendicular to each other.

5. The dielectric double-mode resonator as claimed in claim 3, wherein the cavity resides in the crossing area of the resonator structures.

6. The dielectric double-mode resonator as claimed in claim 1, wherein the first block and the second block are substantially similar.

7. The dielectric double-mode resonator as claimed in claim 1, wherein the resonator structures form a slanted cross-structure to form the inter-coupling of the resonance modes of the resonator structures.

8. The dielectric double-mode resonator as claimed in claim 1, wherein the dielectric double-mode resonator comprises frequency setting means for setting the frequency response of the double-mode resonator.

9. The dielectric double-mode resonator as claimed in claim 1, wherein the dielectric double-mode resonator comprises coupling means for making the coupling between the resonance modes of the resonator structures.

10. The dielectric double-mode resonator as claimed in claim 1, wherein the frequency response of the dielectric double-mode resonator is adjusted by setting the first block and the second block against each other in such a manner that the first block is turned in relation to the second block.

11. The dielectric double-mode resonator as claimed in claim 1, wherein the dielectric double-mode resonator comprises an insulating layer between the blocks for setting the frequency response of the dielectric double-mode resonator.

12. The dielectric double-mode resonator as claimed in claim 1, wherein the dielectric double-mode resonator comprises fastening elements for forming the block structure of the blocks.

13. The dielectric double-mode resonator as claimed in claim 1, wherein the dielectric double-mode resonator comprises a binding agent for fastening the blocks together.

14. The dielectric double-mode resonator as claimed in claim 1, wherein the dielectric double-mode resonator comprises positioning means for positioning the blocks.

15. The dielectric double-mode resonator as claimed in claim 1, wherein the dielectric double-mode resonator comprises a support supporting the blocks for setting the frequency response of the dielectric double-mode resonator.

16. The dielectric double-mode resonator as claimed in claim 1, wherein the dielectric double-mode resonator operates in a band-pass filter.

17. The dielectric double-mode resonator as claimed in claim 1, wherein the dielectric constant of the cavity is substantially smaller than the dielectric constant of the block structure.

18. The dielectric double-mode resonator as claimed in claim 1, wherein the block structure comprises mainly ceramic material.

19. The dielectric double-mode resonator as claimed in claim 1, wherein the block structure comprises mainly barium-titan-oxide.

20. The dielectric double-mode resonator as claimed in claim 1, wherein the dielectric double-mode resonator is a TE double-mode resonator.

* * * * *